United States Patent [19]

Moss

[11] 4,064,663

[45] Dec. 27, 1977

[54] SHELTER AND METHOD OF MAKING SAME

[76] Inventor: Charles W. Moss, Mill St., West Rockport, Maine 04856

[21] Appl. No.: 683,835

[22] Filed: May 6, 1976

[51] Int. Cl.[2] ..... E04B 1/32

[52] U.S. Cl. ..... 52/80; 52/82; 52/86; 52/309.9; 52/741

[58] Field of Search ..... 52/63, 80, 82, 86, 2, 52/309, 741

[56] References Cited

U.S. PATENT DOCUMENTS

| | | | |
|---|---|---|---|
| D. 230,724 | 3/1974 | Infante | 52/80 X |
| 2,388,701 | 11/1945 | Neff | 52/741 X |
| 3,075,654 | 1/1963 | Wheeler | 52/741 X |
| 3,161,553 | 12/1964 | Visser | 52/2 X |
| 3,277,219 | 10/1966 | Turner | 52/2 X |
| 3,572,002 | 3/1971 | Nichols | 52/86 X |
| 3,619,432 | 11/1971 | Harrington | 52/80 UX |
| 3,668,287 | 6/1972 | Mackie | 52/2 X |
| 3,886,961 | 6/1975 | Geiger et al. | 52/82 X |

*Primary Examiner*—Ernest R. Purser
*Assistant Examiner*—Carl D. Friedman
*Attorney, Agent, or Firm*—Olsen and Stephenson

[57] ABSTRACT

Shelters and methods of making them are disclosed which include a basic module that has a frame over which a flexible fabric cover is fitted and appropriately attached so that when distended it will define the configuration of the module. A reinforced rigid plastics foam material is adhered to the outer surface of the flexible fabric cover, and a protective waterproof coating is adhered to the outer surface of the rigid plastics foam material. If desired, portions of the frame can then be removed leaving a self-sustaining shelter.

14 Claims, 22 Drawing Figures

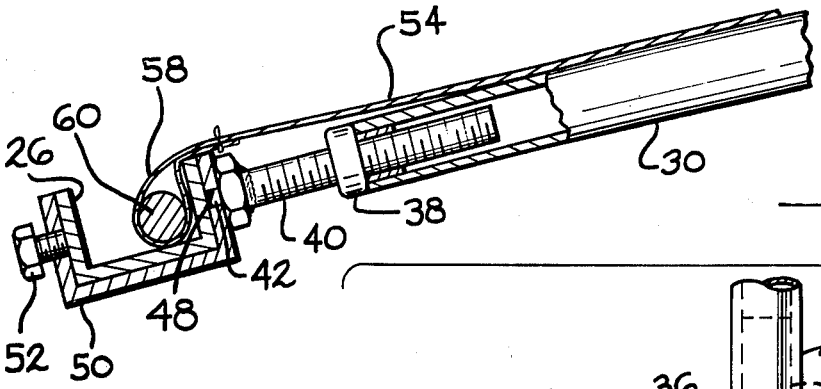
FIG. 4
FIG. 5
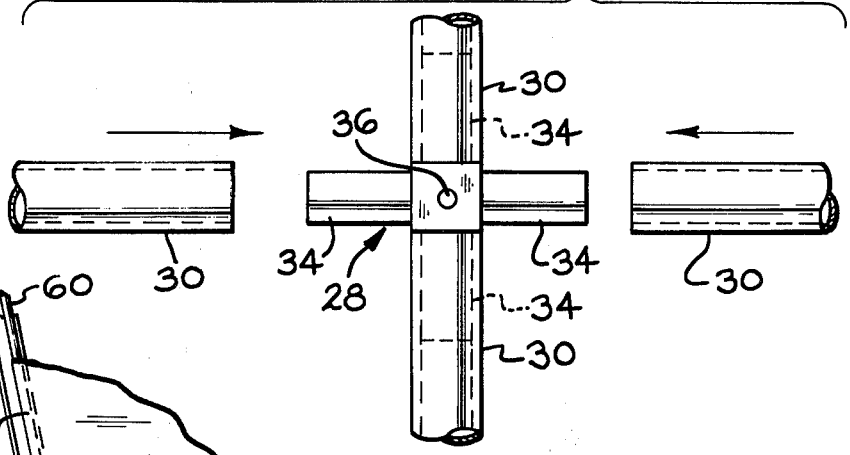
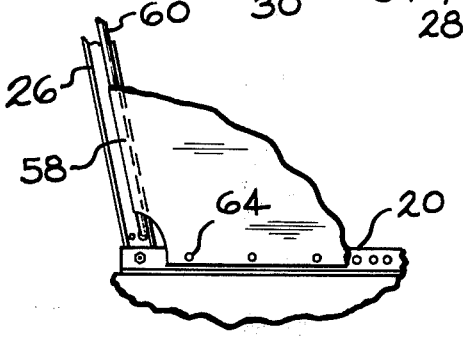
FIG. 7
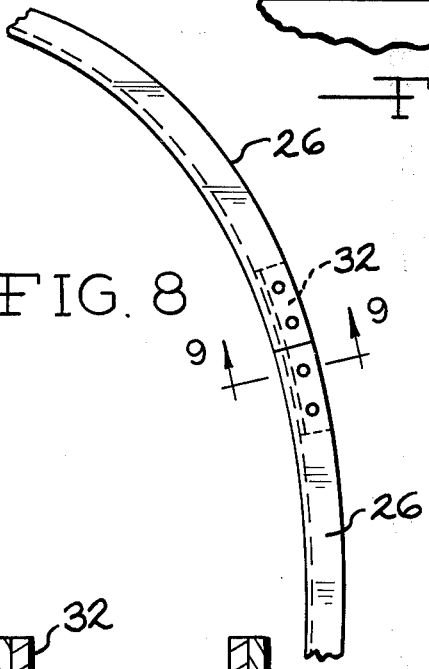
FIG. 8
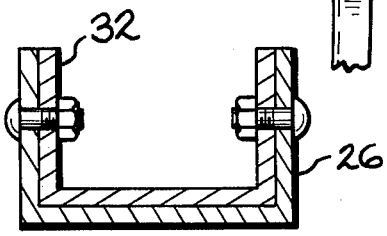
FIG. 9
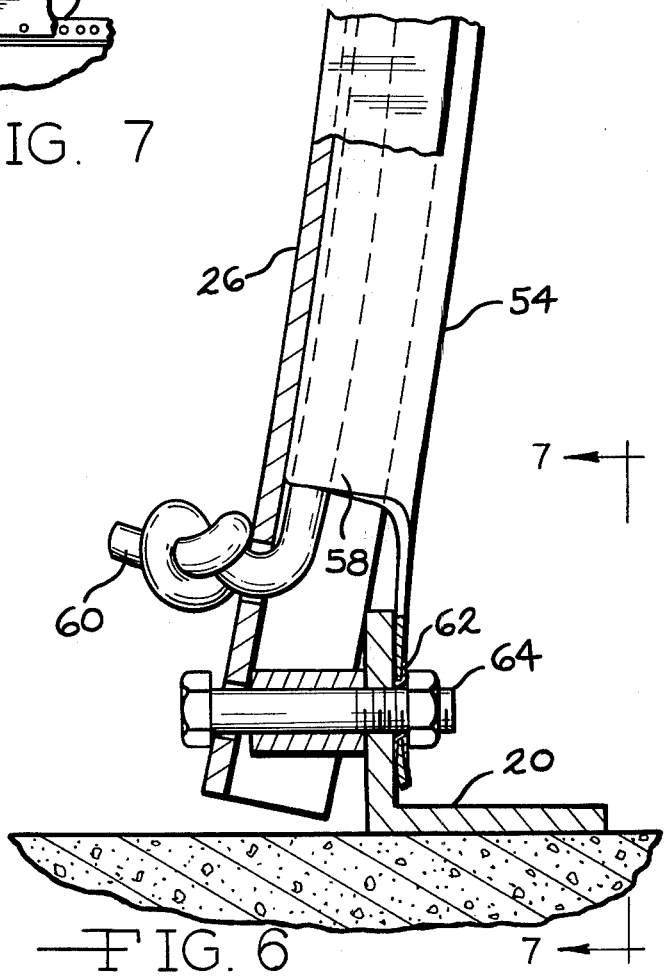
FIG. 6

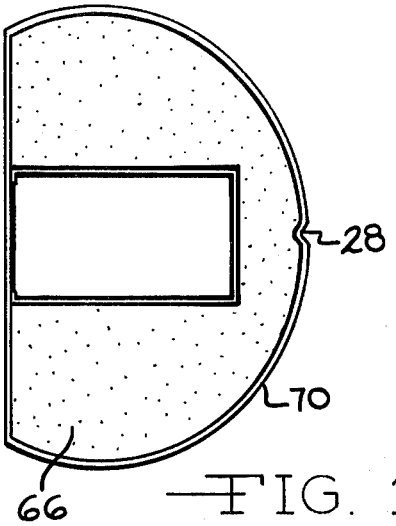
FIG. 18
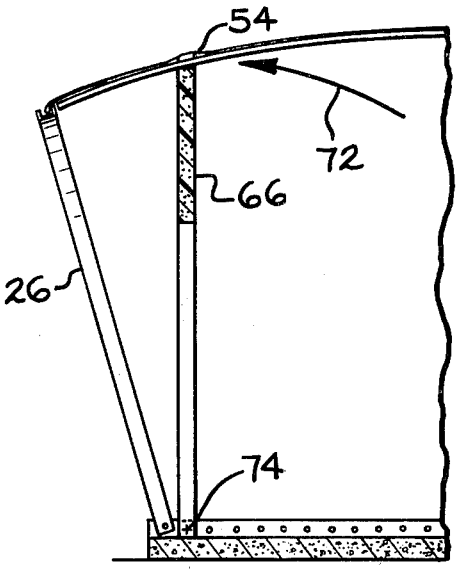
FIG. 19
FIG. 20
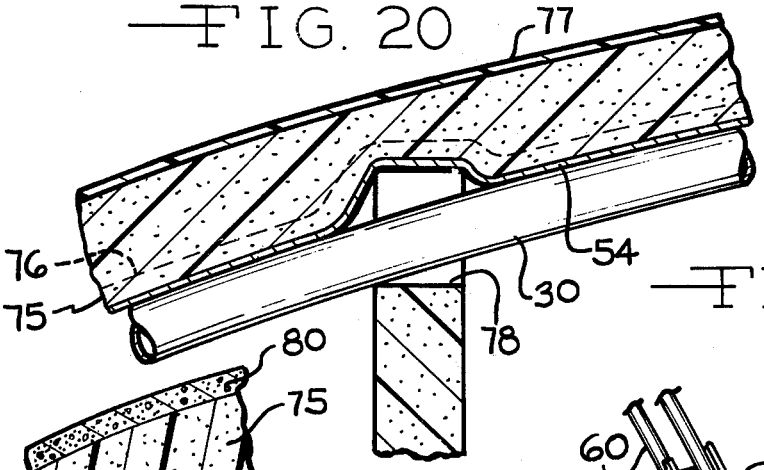
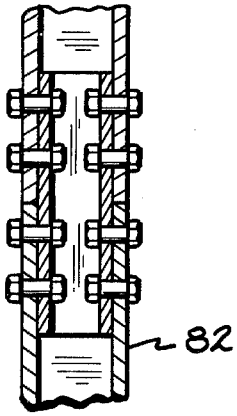
FIG. 16
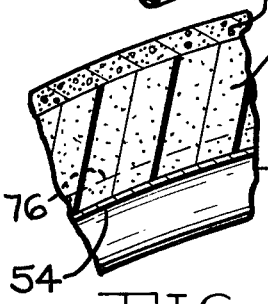
FIG. 22
FIG. 21
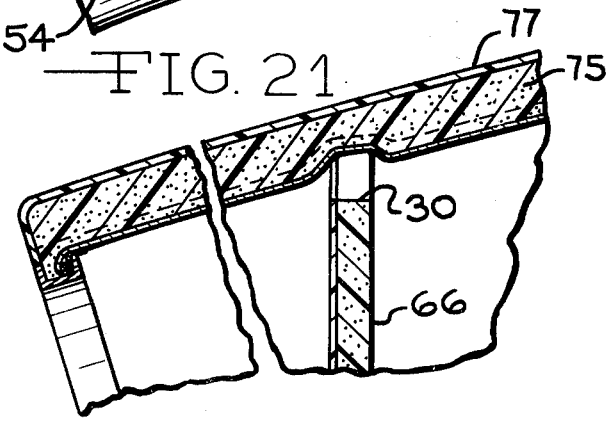
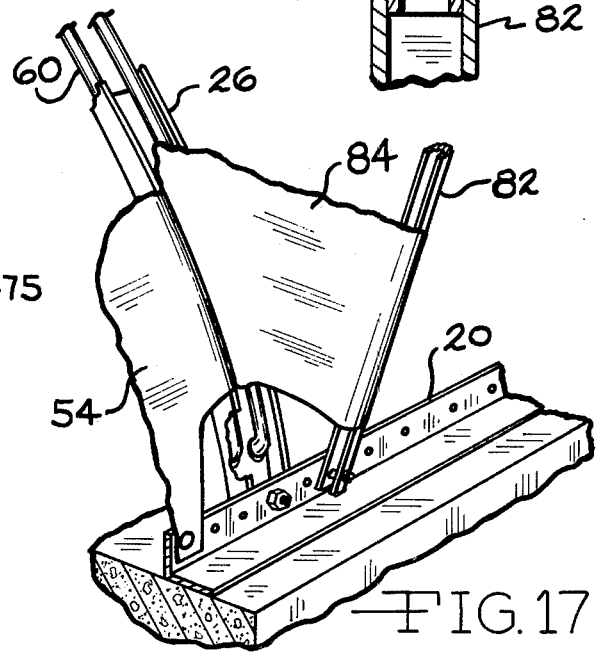
FIG. 17

SHELTER AND METHOD OF MAKING SAME

BACKGROUND OF THE INVENTION

The present invention relates to improvements in shelters, and particularly to shelters that can be constructed conveniently and at low cost in areas where suitable construction materials for erection of dwellings are difficult and costly to obtain.

There is an increasing demand throughout the world for dwellings that can meet the needs of an expanding population and which will provide adequate housing for people of all economic classes. Numerous problems have existed heretofore which have prevented many people from acquiring adequate housing. These problems include, but are not restricted to cost, transportation and labor problems. In many areas of the world facilities are not available to provide necessary building materials, necessitating the shipment of the building materials to those areas if suitable dwellings are to be constructed. In most instances the shipping costs are then prohibitive, and even when delivery to a desired area is feasible from the cost standpoint, it is often found that skilled labor to perform the construction of the dwellings according to conventional building methods is absent. Thus, there is a significant need for an improved building structure that can serve as a dwelling, and to an improved method of erecting the dwelling.

SUMMARY OF THE INVENTION

The present invention has overcome the inadequacies of the prior art and provides a basic shelter module which can, by itself, serve as a shelter, or it can be connected with one or more similar modules to provide an enlarged shelter. Initially, during construction, the module is in essence a tent having a frame on which a flexible fabric cover is distended and the distended cover then serves as a mold on which a shell of foam plastics material is applied and over which a waterproof material is sprayed. The frame can be partially disassembled thereafter, if desired, to enable it to be reused in the construction of other similar modules. The fabric and frame are prefabricated to permit convenient and low cost shipment and to provide, when the cover is distended, a configuration which will enable the applied foam plastics material to be self-sustaining after it has set, even if portions of the frame are removed.

According to a preferred form of the present invention, a basic shelter module is provided having a central vertical axis and comprising a frame mounted on a supporting surface, and a flexible fabric cover connected at its edges to the frame and distended to define convex external configurations. A layer of rigid foam material is adhered to the outer surface of the cover, and a protective waterproof coating is adhered to the outer surface of the layer of rigid foam material. The frame includes rigid base members mounted on the supporting surface so as to define the bottom perimeter of the module, and a plurality of relatively rigid arch members are arranged around the perimeter of the module to face in the direction of the vertical axis and are connected at their bottom ends on the rigid base members. The edges of the flexible fabric cover are connected to the rigid base members and to the rigid arch members.

Initially, during construction of the basic shelter module the frame includes a hub located at the central vertical axis and a plurality of relatively rigid transverse members extending respectively between the hub and the apex of each of the arch members. The cover is fitted over these rigid transverse members and the hub. Suitable connection means are provided between the rigid transverse members and the arch members so as to permit extending the lengths of the rigid transverse members, thereby to tension the flexible fabric cover. The hub and the rigid transverse members may be disconnected from the arch members and removed from the module after the rigid foam material on the external surfaces of the flexible fabric cover has set.

If desired, a plurality of the basic shelter modules can be interconnected by means of a suitable linking module constructed similar to the basic shelter modules. Also, suitable wall panels in which door ways, windows, and the like are located, can be mounted within the openings of the flexible fabric cover defined by the arch members.

According to one method of constructing the basic shelter module, the construction comprises the steps of positioning the frame on a supporting surface, attaching the flexible fabric cover at its edges to the rigid base members and the arch members, fully distending the cover by extending the lengths of the rigid transverse members, spraying organic plastic foam onto the exterior surfaces of the cover and allowing the foam to set to provide a layer or rigid foam adhered to the cover, and thereafter applying a protective waterproof coating onto the material of the exterior surface of the rigid foam. After the foam has set, the hub and the rigid transverse members may be removed, if desired, and they can be subsequently reused in building similar basic shelter modules.

When it is desired to provide wall panels which close the openings under the cover, defined by the arch members, a form can be placed on the supporting surface adjacent to each of the openings in the cover, and a suitable rigid material, such as the plastics foam material or cementitious material can be introduced into the form prior to applying the plastics foam material onto the exterior surface of the cover. When the wall panels have set, they can be pivoted into position under the cover adjacent to the arch members so as to partially indent the surfaces of the cover. Thereafter when the plastics foam material is applied to the external surface of the cover and has set, the panels will be locked within the roof structure of the module. To facilitate interlocking the wall panels with the roof structure in this manner, it is preferred that the arch members be supported so that they are inclined outwardly from the vertical to provide an overhang at each of the openings in the flexible fabric cover defined by the arches.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 4 is an enlarged fragmentary section taken on the lines 4—4 of FIG. 1, showing the arrangement for interconnecting the arch members with the transverse members of the frame;

FIG. 5 is an exploded, enlarged fragmentary bottom plan view of the hub member to which two transverse frame members have been connected and two other transverse frame members are in position to be connected;

FIG. 6 is an enlarged fragmentary view, partly in section and taken in the direction of the arrows 6—6 of FIG. 1, showing the arrangement for connecting the arch members to the base members and for connecting the flexible cover to the arch members;

FIG. 7 is a fragmentary side elevational view taken on the lines 7—7 of FIG. 6, showing further details of the arrangement for connecting the flexible cover to the frame;

FIG. 8 is a fragmentary front elevational view showing details of construction of the arch members;

FIG. 9 is an enlarged section taken on the lines 9—9 of FIG. 8;

FIG. 16 is an enlarged fragmentary section taken on the lines 16—16 of FIG. 13, showing an arrangement for joining various parts of the arch member;

FIG. 17 is a fragmentary perspective view showing details for interconnecting the basic shelter module and the linking shelter module;

FIG. 18 illustrates the step of forming a wall panel within a form;

FIG. 19 is a fragmentary section, showing the step of positioning of the wall panel adjacent to one of the arch members, during the forming of the module;

FIG. 20 is an enlarged fragmentary section showing the arrangement whereby the wall panel is interlocked into the top wall of the module after the plastics foam material has set on the exterior surface of the flexible fabric cover;

FIG. 21 is a view similar to FIG. 20, but with the transverse frame member removed; and FIG. 22 is a view similar to FIG. 21, but showing a modified construction of the top wall of the module, wherein a cementitious material has been applied to the flexible fabric cover in place of the plastics foam material.

DESCRIPTION OF THE PREFERRED EMBODIMENTS

Figure 1:
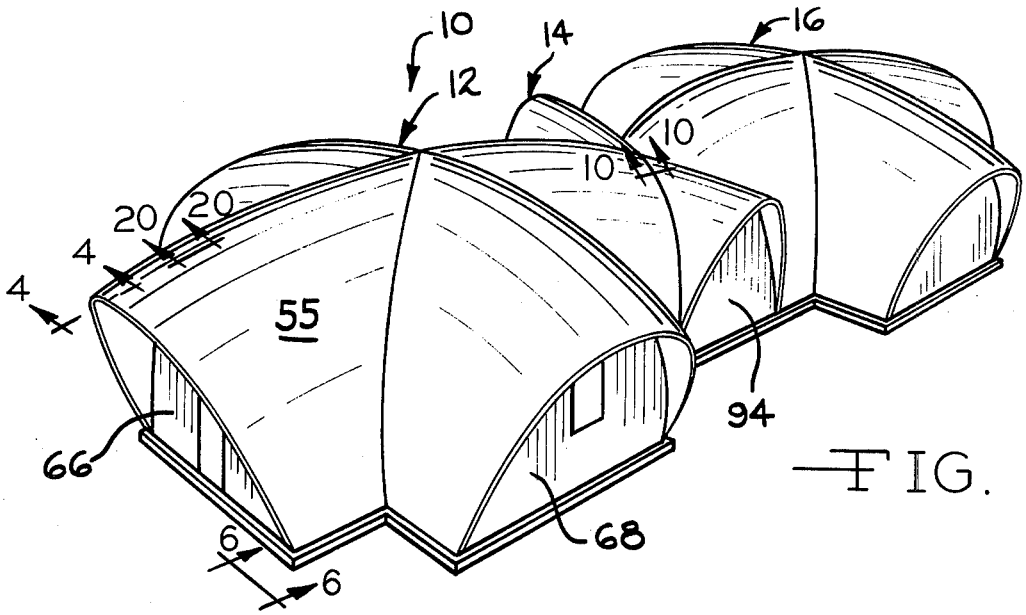
FIG. 1 is a perspective view of one embodiment of the present invention illustrating two basic shelter modules interconnected by a linking module.
Figure 2:
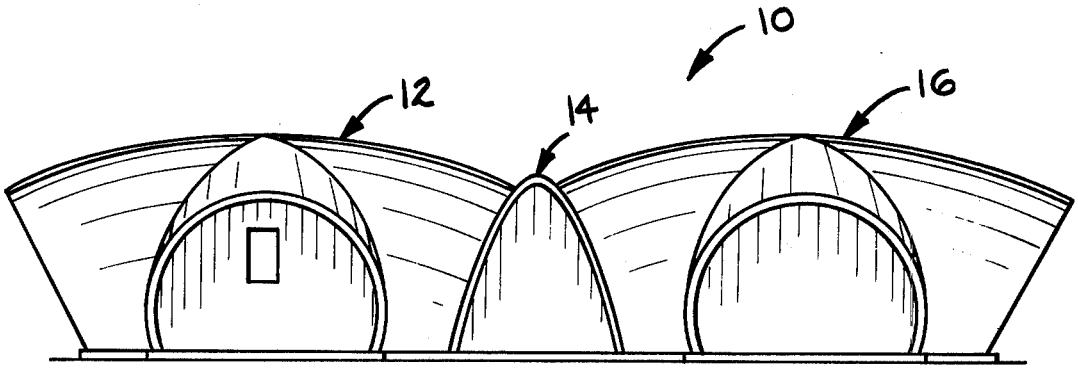
FIG. 2 is a front elevational view of the shelter illustrated in FIG. 1.
Figure 3:
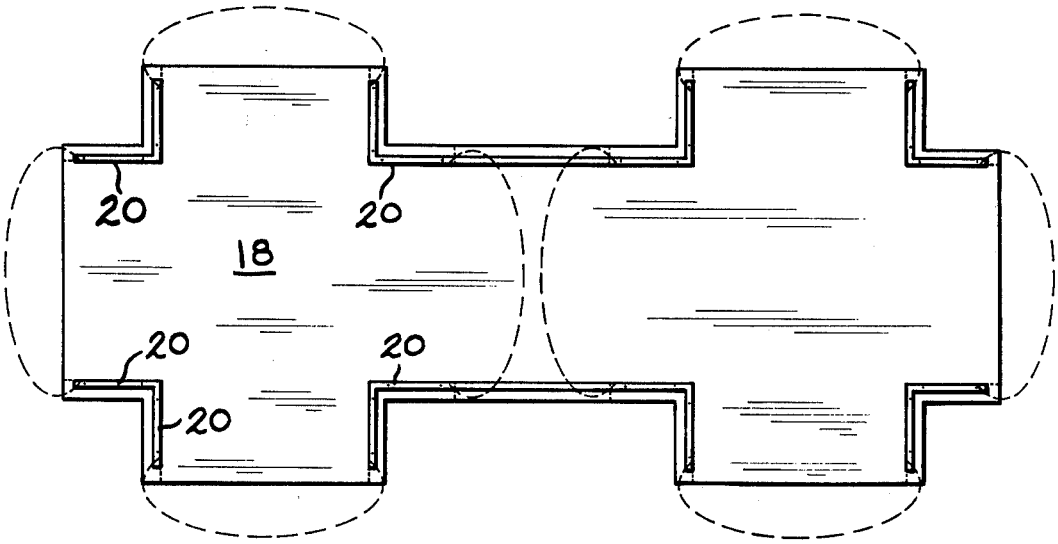
FIG. 3 is a top plan view of the supporting surfaces and base frame members of the shelter shown in FIG. 1, and showing in broken lines the arch members of the frames of the modules.
Figure 13:
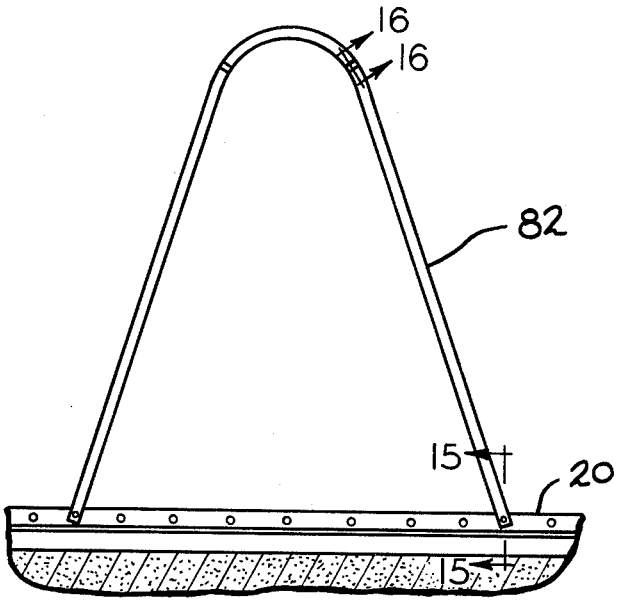
FIG. 13 is a front elevational view of one arch member of the linking module, other portions being removed for purposes of illustration.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The enlarged shelter 10 comprises the first basic shelter module 12, the linking module 14 and the second basic shelter module 16. Various other arrangements of enlarged shelters utilizing basic shelter modules and linking modules can be constructed without departing from the scope of the present invention. Initially, the first basic shelter module 12 will be described, and a detailed description of the second basic shelter module 16 will be omitted, because the latter is constructed essentially identically the same as the first basic shelter module 12.

Figure 12:
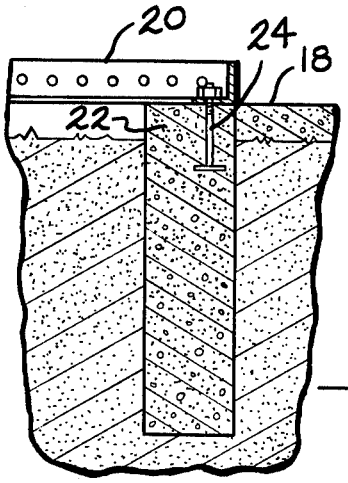
FIG. 12 is a fragmentary section taken on the lines 12—12 of FIG. 11.

When constructing a shelter 10, whether it be a single basic shelter module or a plurality of interconnected shelter modules, a supporting surface 18 will initially be prepared. For this purpose rigid base members 20 of a frame (to be described) are initially secured in place. Preferably, this is done in a manner such as is shown in FIG. 12 after a suitable concrete footing 22 has been provided for supporting the base members 20. It will be observed that tie bolts 24 are anchored in the footing 22 and to which the base members 20 are attached. The footings 22 and base members 20 are suitably located so that the base members 20 define the outer perimeter of the base of the basic shelter module 12. The supporting surface 18 may also be a concrete surface, if desired.

For the initial construction of the basic shelter module 12, a frame is provided which comprises the relatively rigid base members 20, relatively rigid arch members 26, a hub 28 and a plurality of relatively rigid transverse members 30. The rigid base members 20 can be straight angle irons which have apertures suitably located in their flanges for attachment to the tie bolts 24 and to provide attachment means for various components of the basic shelter module 12.

The relatively rigid arch members 26 preferably in cross-section are in the form of a U-shaped channel, as can be seen best in FIG. 9, and can be made in a plurality of sections which can be joined together by U-shaped inserts 32, as is illustrated in FIGS. 8 and 9.

In the illustrated embodiment of the invention, the hub 28 includes four radially arranged pins 34 adapted to receive hollow ends of the relatively rigid transverse members 30. A pin 36 is provided on the bottom of the hub 28 for use when the hub is elevated on a lifting rod (not shown) during the initial assembly of the basic shelter module 12. The transverse members 30 are open at their inner ends to fit over the pins 34, as previously described, and the outer ends of the transverse members 30 have an internally threaded bore member 38 rigidly secured thereto. Threadedly connected within each member 38 is an extension shaft 40 which has a head 42 for receiving a tool to permit turning of the shaft 40 for extending and retracting the length of the transverse member 30. The end of the shaft 40 has a projection 42 thereon which can penetrate the hole 48 in the inverted saddle member 50 which is retained on the arch member 6 by means of the fastening element 52. Thus, to erect the basic shelter module 12, the inverted saddle member 50 can be secured onto the arch member 26 at its apex and the transverse member 30 can be positioned between the hub 28 and the aperture 48 located at the apex of the arch member 26 and extended so as to provide with base members 20 and arch members 26 a frame on which the flexible fabric material 54 can be fitted.

The flexible fabric cover 54 that forms the substrate of the wall structure 56 can be any suitable tent material, and in the illustrated embodiment of the invention is an 8.98 ounce cotton duck material. Preferably, it will have a decorative inner surface. The fabric cover 54 is cut into a number of sections which are sewed together to define the general configuration of the wall structure 55, when the cover is fully distended. The cover 54 has tunnels formed at those of its edges which define the openings formed at the arch members 26. The tunnels 58 have nylon ropes 60 or other suitable cords extending through them for tying the tunneled edges of the cove 54 into the channels of the arch members 26, as can be seen best in FIGS. 4, 6 and 7. The remaining edges of the cover 54 extend down to the base frame members 20 and have grommets 62 along the bottom edge whereby suitable fastening means 64 can be utilized to secure the cover 54 to the base members 20. When the edges of the cover 54 have been secured in place within the arch members 26 and attached to the base members 20, the hub 28 to which transverse members 30 have been fitted can be elevated to distend the cover 54, and the latter can be fully tensioned to the shape of the module shown in FIG. 1 by using the extension means located at the radially outer ends of the transverse members 30 in conjunction with the inverted saddles 50 that have been attached at each of the apexes of the arch members 26.

If wall panels are to be provided in the openings at the arch members 26, they will be constructed and inserted in place at this time. Wall panels can have a door formed therein as shown by the panel 66, or if desired, they may have a window therein as shown by the wall panel 68 in FIG. 1. The wall panels can be formed directly on the supporting surface 18 by placing a frame 70 thereon which is contoured to conform nearly to the shape of the cover 54 as it exists in a vertical plane adjacent to the base of the arch member 26, as can be seen in FIG. 19. One convenient arrangement for forming the panel 66 is to place a sheet of the cotton duck material that is used to form the cover 54 on the supporting surface 18, and then place the frame 70 thereon. Thereafter the foam plastics material that will subsequently be used to form the top wall construction is then introduced into the frame 70 and allowed to set. A panel 66 such as is shown in FIG. 8 will then be formed, and the latter can then be pivoted as shown by the arrow 72 in FIG. 9 to the vertical position shown. To aid in the installation of the wall panel 66, the arch members 26 are inclined to the vertical as can be seen in FIG. 19 to provide an overhang. When the wall panel 66 is pivoted to the vertical position after it has been connected at 74 to base members 20 for pivotal movement, the dimensions selected from the exterior periphery of the panel 66 will be such as to cause the panel to indent the cover 54 in an outwardly direction as can be seen in FIGS. 19 and 20. This feature will serve to interlock the wall panels with the finished wall structure 55.

To the exterior of the fabric cover 54 are now applied three layers of foam plastics material 75, and preferably a sodium silicate foam is used for this purpose. In the illustrated embodiment of the invention the layers each have a thickness of one inch. Between the first and second layers has been placed a layer of a suitable mesh material 76, which in the present instance is dacron scrim material, which is a coarsely woven fabric. During construction, each layer is allowed to set firmly before the next layer is applied. Setting time may vary from one to several hours, depending upon atmospheric conditions.

The sodium silicate foam is produced by mixing together the following ingredients:

Sodium Silicate Solution
Powdered Filler Material
Surfactant
Chopped Glass Fibers
Infrared Inhibiting Agent
Hardener The mixing takes place in a pot pressurized to approximately 80 psig and equipped with beaters which whip the ingredients to a consistency which resembles aerosol shaving foam. After 4½ to 5 minutes of mixing, the contents of the pot are forced out of the pot under pressure down the supply hose to the nozzle of spray apparatus. The nozzle contains an orifice through which compressed air is blown. The air entrains the silicate foam and propels it to the surface to be coated.

After the final coat of foam has been applied, a protective waterproof coating 77 is sprayed on. A preferred coating is one that is manufactured by the Dow Corning Corporation and is designated as S-5000 Construction Coating, a silicone rubber-based compound which contains approximately 15% Xylene. It is blended in a 1:1 ratio with an Isonate Curing Agent manufactured by Upjohn Chemical Company and designated as CPR-485. It is applied with a standard spray gun under high pressure (approximately 3,500 psi). Two coats are normally required for coverage of 0.020 inch depth, which is considered to be the optimum thickness. Any water barrier film coating may be used in this application including elastomers in latex form, solution form, or prepolymeric liquids which cure by reaction with air or added curing agents such as urethanes, polyesters, epoxides, drying oils (linseed, tung, japan, etc.) combination of the above, or other such materials as are known to the art.

When constructing the panel 66, a notch 78 was formed in the wall panel of a size sufficient for passage of the transverse member 30. If desired, the extension means provided by the shaft 40 can now be retracted and the transverse members 30 together with the hug 28 can be removed, as shown in FIG. 21. These portions of the rame can be reused in connection with building other basic shelter modules, thereby reducing to a minimum the material and supplies that must be shipped to a remote location for use in constructing basic shelter modules.

It is to be understood that other suitable materials may be used when constructing the basic shelter module. Thus, as shown in FIG. 22, a suitable cement material 80 may be sprayed onto the previously applied and now rigid foam material 75.

Figure 14:
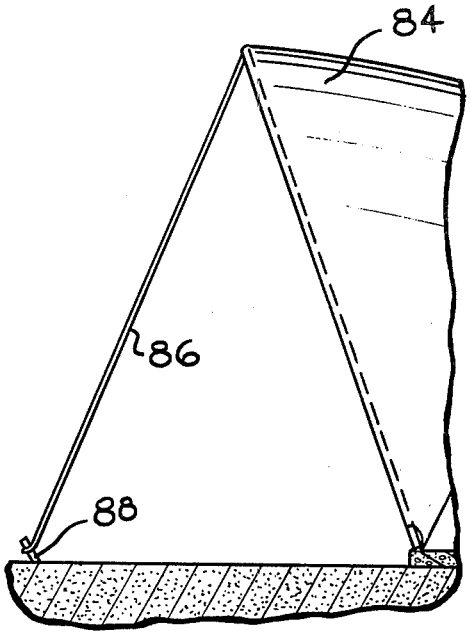
FIG. 14 is a fragmentary side elevational view of the linking module of FIG. 13, illustrating the arrangement for the initial positioning of the arch member of the linking module for construction purposes.
Figure 15:
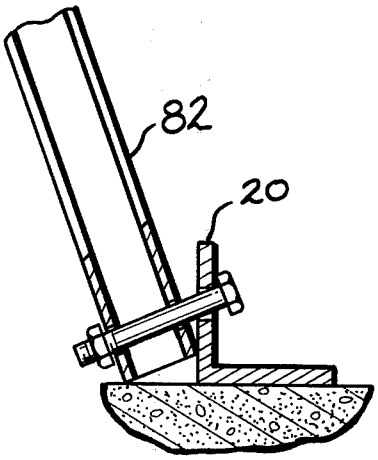
FIG. 15 is an enlarged fragmentary section taken on the lines 15—15 of FIG. 13, showing one arrangement for connecting the arch member of the linking module to the base member.
Figure 11:
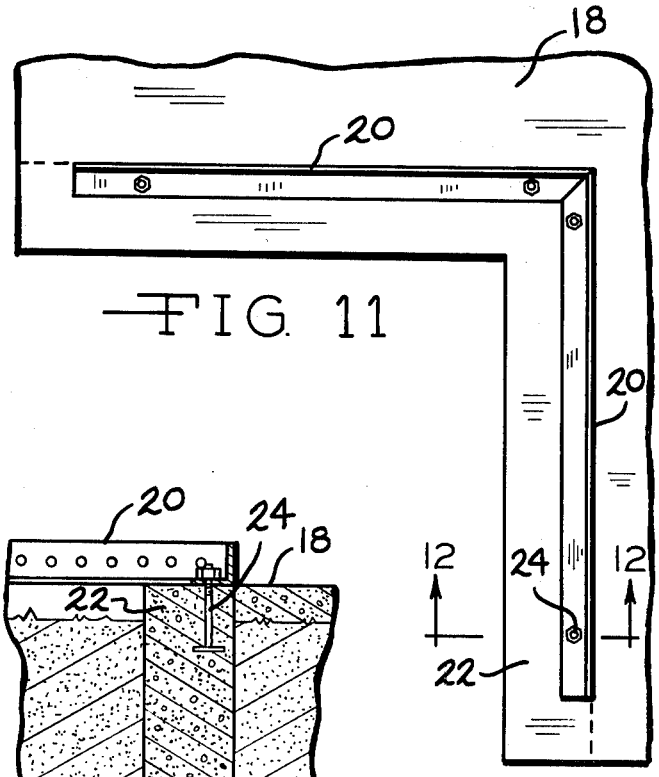
FIG. 11 is a fragmentary top plan view showing details of mounting the rigid base members of the frame in the supporting surface.
Figure 10:
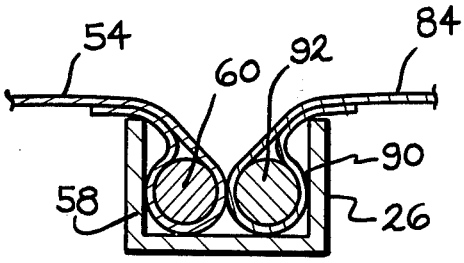
FIG. 10 is an enlarged fragmentary section taken on the lines 10—10 of FIG. 1, showing the arrangement for interconnecting the cover of one basic shelter module and the cover of the linking module.

When it is desired to build an enlarged shelter, such as is shown for example in FIG. 1, a linking module 14 can extend between and connect the first and second modules 12 and 16. The linking module has arch structures 82 at opposite ends which are adapted to extend through tunnels in the flexible fabric cover 84 of the linking module. The cover 84 will have edges at its longitudinal ends which are tubular and can receive the arch structures 82. The latter can then be suitably connected to base members 20, as shown for example in FIG. 15. The fabric cover can be tensioned by means of a rope or cord 86 which can be connected to the apex of the arch member 82 and secured to the supporting surface by a pin 88, as can be seen in FIG. 14. The remaining edges of the fabric cover 84 also have tunnels 90 therein so that they can be retained in the arch member 26 and secured in place by the nylon line or rope 92, as shown in FIG. 10. When an enlarged structure of this type is being constructed, the layers of material applied to the exterior surface of the fabric cover 84 will be identically the same as that which is applied to the fabric cover 54. Also, wall panels 94 can be formed in the openings defined by the arch structures 84, as shown in FIG. 1, these panels being essentially the same as the panels described in connection with the first basic module 12.

It is claimed:

1. A basic shelter module adapted to be used either singly or interconnected with one or more similar modules to form a shelter, comprising a frame mounted on a supporting surface, a flexible fabric cover supported by said frame and defining when distended convex external configurations, a layer of rigid foam material adhered to the outer surface of said cover so as to aid in supporting the distended cover, and a protective waterproof coating adhered to the outer surface of said layer of rigid foam material, said frame including a plurality of relatively rigid arch members arranged to face a common center and rigid base members mounted on the supporting surface so as to define a bottom perimiter of the module, the bottom ends of said rigid arch members being pivotally connected to said base members, said cover being attached at some of its edges to said arch members and attached at the other of its edges of said base members, said frame also including a hub centered between said arch members, and a plurality of relatively rigid transverse members extend respectively between said hub and the apex of each arch member, each of said transverse members including an extension member movably connected therewith and selectively movable to extend and retract the length of said transverse member, said transverse members being extensible to pivot said arch members outwardly to tension said cover during one step of erection of said basic shelter module, each of transverse members being releasable from its associated arch member for optional removal from said module when said rigid foam material has cured following initial application of the foam material onto the cover.

2. The basic shelter module that is defined in claim 1, wherein a reinforcing netting is embedded in said rigid foam material.

3. The basic shelter module that is defined in claim 1, wherein said coating is a cementitious material.

4. The basic shelter module that is defined in claim 1, wherein said coating is an elastomeric material.

5. The basic shelter module that is defined in claim 1, wherein said arch members are inclined radially outwardly from said hub so that an overhang of fabric cover occurs at openings in the fabric cover defined at each arch member.

6. The basic shelter module that is defined in claim 1 further including vertical panels connected to said rigid base members at the lower ends of said arch members and having their upper edges conforming to contours of said fabric cover to form closures of the openings defined at the arch members, said vertical panels being dimensioned relative to said fabric cover so that during initial assembly the upper edge of each panel indents the underside of the fabric cover and the edge is embedded in the applied foam material.

7. The basic shelter module that is defined in claim 1, wherein said foam material is a sodium silicate foam and said waterproof coating is a silicone rubber-based material.

8. The basic shelter module that is defined in claim 7, wherein said foam material has a thickness of about 2 to 3 inches and has embedded therein a fabric netting, and said waterproof coating has a thickness of about 0.02 inch.

9. The basic shelter module that is defined in claim 1, wherein said foam material is a sodium silicate foam and said protective waterproof coating is a portland cement plaster.

10. The basic shelter module that is defined in claim 9, wherein said foam material has a thickness of about 2 to 3 inches and has embedded therein a fabric netting, and said cementitious material has a thickness of about ½ inch.

11. The basic shelter module that is defined in claim 1, wherein said fabric cover is a cotton duck material.

12. The basic shelter module that is defined in claim 11, wherein said cotton duck material has a decorative interior surface.

13. A shelter comprising a first basic shelter module, each module including a frame mounted on a supporting surface, a flexible fabric cover supported by said frame and defining when distended convex external configurations, a layer of rigid foam material adhered to the outer surface of said cover so as to aid in supporting the distended cover, and a protective waterproof coating adhered to the outer surface of said layer of rigid foam material, said frame including a plurality of relatively rigid arch members arranged to face a common center and pivotally mounted at their bottom ends on the supporting surface, said frame also including a hub located at said common center, and a plurality of relatively rigid transverse members extending respectively between said hub and the apex of each arch member, said transverse members being extensible to pivot said arch members outwardly to tension said cover during one step of erection of each module, said cover being attached at some of its edges to said arch members, said first and second modules being positioned with one arch member of one facing one arch member of the other in close-spaced relationship, and a linking module extending between and connecting said first and second modules, said linking module extending transversely to the axes of the facing arch members and having a frame including arch structures, and a flexible fabric cover formed from a plurality of fabric sections joined together to define when distended a plurality of convex surfaces, edge portions of the cover of the linking module being contoured to conform to the edge portions of the covers of the first and second basic shelter modules at the openings defined at their arch members and having means for connecting the adjacent edge portions, said linking module including a layer of rigid foam material and a protective waterproof coating adhered to the outer layer of rigid foam material.

14. A method of constructing a basic shelter module comprising the steps of 1. positioning on a supporting surface a frame which includes rigid base members defining the bottom perimeter of the module and a plurality of upright rigid arch members positioned at their lower ends on said bottom perimeter;
2. attaching some of the edges of a flexible fabric cover member to said arch members and other of the edges of the flexible fabric cover member to said rigid base members, and securing the lower ends of the arch members to said rigid base members;
3. distending said cover by initially positioning within said cover extensible rigid transverse members that extend between and engage the upper portions of opposite pairs of arch members and then extending said transverse members to tension said cover;
4. applying a first layer of sodium silicate foam onto the exterior surface of the distended cover and allowing it to set;
5. placing a layer of dacron scrim material over the first layer of set foam;
6. applying additional sodium silicate foam onto the layer of dacron scrim material and allowing it to set;
7. applying a protective waterproof coating of silicone rubber-based material onto the set foam; and
8. contracting and removing said transverse members.

* * * * *

UNITED STATES PATENT OFFICE

CERTIFICATE OF CORRECTION

Patent No. 4,064,663 Dated December 27, 1977

Inventor(s) Charles W. Moss

It is certified that error appears in the above-identified patent and that said Letters Patent are hereby corrected as shown below:

Claim 1, line 41, "of" , second occurrence, to read -- to --.

Claim 1, line 52, "each of transverse members" should read as follows --each of said transverse members--.

Claim 13, line 35, "A shelter comprising a first basic shelter module," should read as follows --A shelter comprising a first basic shelter module, and a second basic shelter module--.

Signed and Sealed this

Second Day of May 1978

[SEAL]

Attest:

RUTH C. MASON
Attesting Officer

LUTRELLE F. PARKER
Acting Commissioner of Patents and Trademarks